US006837119B2

(12) United States Patent
Blackwood-Sewell

(10) Patent No.: US 6,837,119 B2
(45) Date of Patent: Jan. 4, 2005

(54) PIPETTES

(76) Inventor: Miles Athol Blackwood-Sewell, 3 Flint Court, Buderim, Queensland 4556 (AU)

( * ) Notice: Subject to any disclaimer, the term of this patent is extended or adjusted under 35 U.S.C. 154(b) by 0 days.

(21) Appl. No.: 10/187,776

(22) Filed: Jul. 1, 2002

(65) Prior Publication Data

US 2003/0115974 A1 Jun. 26, 2003

(30) Foreign Application Priority Data

Jul. 3, 2001 (AU) ..... PR 6056

(51) Int. Cl.[7] ..... B01L 3/02

(52) U.S. Cl. ..... 73/864.01; 73/431; 73/863.32; 422/100

(58) Field of Search ..... 73/864.01, 863.32, 73/431, 864.13, 864.17, 1.74; 422/100; D24/222

(56) References Cited

U.S. PATENT DOCUMENTS 3,647,506 A * 3/1972 Greil ..... 427/559
3,663,155 A * 5/1972 Gray et al. ..... 8/505
3,905,366 A 9/1975 Callahan et al. ..... 604/209
4,228,922 A 10/1980 Takeshita ..... 222/47
4,877,585 A * 10/1989 Perlman ..... 422/100
5,058,441 A * 10/1991 Whelan ..... 73/864.15
5,563,356 A * 10/1996 Mussi et al. ..... 73/864.14

FOREIGN PATENT DOCUMENTS

FR 2619922 3/1989

OTHER PUBLICATIONS

European Search Report for EP 02254570.

* cited by examiner

*Primary Examiner*—Hezron Williams
*Assistant Examiner*—Rodney Frank
(74) *Attorney, Agent, or Firm*—Renner, Otto, Boisselle & Sklar, LLP

(57) ABSTRACT

The present invention provides a pipette having a body (2), a casing (4), sheathing the body (2), and a graduation means (6) located between the body (2) and the casing (4).

22 Claims, 1 Drawing Sheet

PIPETTES

The present invention relates to pipettes, preferably, but not exclusively to graduated pipettes.

Graduated pipettes are commonly used in laboratories. The graduations are generally represented as a scale extending along the length of the pipette.

Pipettes, especially those used in laboratories, are manufactured as both disposable and non-disposable products. The method of manufacture of a pipette is generally determined by the expected use and service life of the pipette. Disposable pipettes, both glass and plastic, are required to be more cheaply manufactured than non-disposable pipettes, because they are often used only once before disposal. Therefore, disposable glass pipettes are usually made from light gauge glass and the graduation markings are applied with surface bound inks that are less robust than those used in making non-disposable pipettes. Non-disposable pipettes are generally manufactured from heavier gauge glass and the graduation marks are applied in such a way as to be substantially permanent. In the case of non-disposable pipettes, enamel heat cured inks are sometimes used, but in other cases the graduation marks are sintered into the glass using, for example, silver nitrate.

In both disposable and non-disposable pipettes, the markings are applied to the exterior surface of the pipette.

There are several disadvantages to using this method of construction to manufacture a non-disposable pipette. In the case of enamel inks, the positioning of the graduation graphics on the surface leads to the marks being susceptible to contact with and environment and/or chemicals with which the pipette may be used. Exposure to aggressive chemicals can lead to deterioration of the markings. Furthermore, enamel inks may contain heavy metals and other elements that may contaminate a chemical with which the pipette is used. A disadvantage of using silver nitrate to create graduation markings is that they can be produced in dark shades only. Dark markings can be difficult to see when the pipette is used with dark liquids. Another disadvantage of using silver nitrate results from the stringent environmental controls over its use, which are required in order to meet the requirements of environmental agencies. Moreover, in providing a non-disposable pipette using known construction methods, if a single structural element is used, a better quality or more robust gauge of glass must be used in order to reduce the likelihood of breakage.

It is an object of preferred embodiments to provide an improved pipette.

The present invention provides a pipette comprising a body, a casing and a graduation means, wherein the body comprises an elongate tubular member, which body is sheathed along part, at least, of the length thereof by the casing and the graduation means is located between the body and the casing.

The present invention may comprise a disposable pipette, but preferably provides a non-disposable pipette.

Suitably, the body has a tapered section at one end thereof. The body may comprise a tubular member of any suitable cross-sectional shape. Preferably, the body comprises a tubular member of substantially circular cross-sectional shape.

The body may comprise any suitable material, for example, plastics material or glass.

The casing suitably has a similar conformation to the body. Suitably, the casing extends along sufficient length of the body to cover the whole of the graduation means. The casing may extend along substantially the whole length of the body. If the body comprises a tapered section, the casing may extend over the tapered section, but preferably stops short of the tapered section.

The casing may comprise any suitable material. Preferably, the casing comprises a plastics material. The casing advantageously provides a barrier between the graduation means and the external environment.

Suitably the casing is sealed at one, and preferably at both, ends thereof. The casing is suitably sealed in such a manner as to restrict, and preferably prevent, fluid entering between the body and the casing.

The casing is suitably translucent and is preferably substantially transparent.

The graduation means may comprise graduation markings applied directly to the body, preferably to the exterior surface thereof, by any suitable means. The graduation means may comprise graduation markings applied directly to the casing, preferably to the interior surface thereof, by any suitable means.

Suitably, the graduation means comprises a substrate to which graduation markings have been applied. Suitably, the substrate is a film. The film is suitably translucent and is preferably substantially transparent. Suitably, the substantially the whole, and preferably the whole, of the substrate is sandwiched between the body and the casing.

Suitably, the material used to provide the graduation markings provides graduation markings that are coloured. Suitably, the graduation markings are coloured such that they are clearly visible when the pipette contains both a dark coloured liquid and a light coloured liquid. In this case, a pipette according to the present invention advantageously comprises graphics that are clearly visible when pipetting liquid of any colour.

A pipette according to the present invention may further comprise a substance applied between the body and the casing to increase the transparency of the pipette.

The present invention further provides a method of manufacturing a pipette, comprising the steps of, positioning a graduation means between a body and a casing and sheathing part, at least, of the body with the casing such that the graduation means is located between the body and the casing.

The method may comprise a method of manufacturing a disposable pipette, but suitably comprises a method of manufacturing a non-disposable pipette.

The method according to the present invention suitably comprises a method of manufacturing a pipette according to the present invention. The method according to the present invention suitably comprises a method of manufacturing a pipette having any of the features of the pipette according to the present invention.

Suitably, the exterior surface of the body is sheathed by the casing.

The step of positioning the graduation means between the body and the casing may comprise applying the graduation means to the body. The graduation means is preferably applied to the exterior surface of the body.

Alternatively or in addition, the step of positioning the graduation means between the body and the casing may comprise applying the graduation means to the casing. The graduation means is preferably applied to the interior surface of the casing.

If the graduation means is applied to either the casing or the body, any suitable method of application may be used. For example, if the graduation means comprises graduation markings, they may be printed or etched onto the surface of the body or the casing. By way of further example, the graduation marking may be an integral part of either the body or the casing. If the graduation means comprises a substrate to which graduation markings have been applied, the substrate may be applied to the body of the casing by adhesive or such like.

The graduation means need not be applied to either the casing or the body, but may instead simply be located therebetween. In this case, the step of sheathing the body with the casing suitably fixes the graduation means in the appropriate location.

A method according to the present invention may further include the step of sealing the interface between the body and the casing.

Suitably, the step of sealing the interface between the body and the casing involves providing a seal between part at least of the interface between the casing and the body such that substantially no liquid can pass between the casing and the body.

Sealing the interface between the casing and the body may involve attaching part at least of the casing to the body. Suitably, one or both ends of the casing are attached to the body. Part, substantially the whole or the whole of the casing may be attached to the body.

Alternatively, or in addition, a sealing means may be located between the casing and the body.

Embodiments of the present invention advantageously provide a pipette equipped with graphics that are protected from contact with the environment and/or substances with which the pipette is to be used. Since the graphics of the graduation means are situated within the structure of the pipette, the graphics may be provided by simple inks, rather than more expensive inks designed to with stand attack in corrosive environments.

Other advantages of the present invention resides in the use of a body and casing, which allows materials of inferior quality to be used to make a more robust pipette. For example, materials that would previously only have been used to manufacture disposable pipettes, may be used to provide a non-disposable pipette according to the present invention. Materials of inferior quality, formerly suitable to make pipettes of disposable quality only, may be imbued with superior properties that enable such materials to be used to make a non-disposable pipette of superior quality.

Location of the graduation means between the body and the casing in accordance with the present invention, advantageously provides a pipette marked with graphics comprising inks that do not require high temperature curing.

The casing of a pipette in accordance with the present invention, is also advantageous in providing structural reinforcement to the pipette.

Embodiments of the method of the present invention advantageously provide a three element construction, used to simultaneously strengthen the pipette and enable positioning of the graphics away from the exterior surface of the pipette to within the structure of the pipette where the graphics will not be attached by the environment about the pipette. Thus enabling manufacture of a pipette having indelible graphics provided by the graduation means, made by using simple printing inks capable of producing graphics in any colour.

A pipette according to embodiments of the present invention is advantageously stronger than a conventional pipette made from corresponding materials. Embodiments of the present invention provide a substantially unbreakable plastics non-disposable pipette with graduation means that are substantially protected from environmental attack and wear and tear. Such a pipette may comprise simple inks to provide the graduation means such that graphics of any colour or shade may be provided and remain clearly visible when pipetting liquids of any colour.

The present invention will now be described, by way of example only, with reference to the following drawings, in which.

Figure 1:
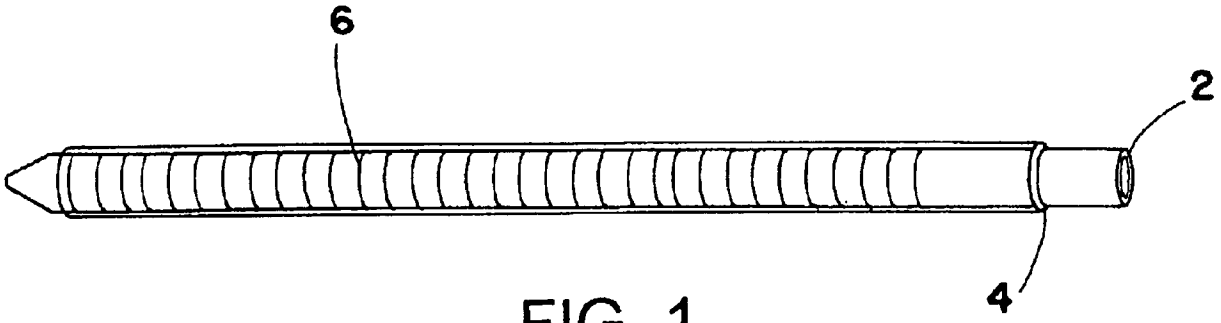
FIG. 1 is a perspective view of a pipette.

FIG. 1 shows a pipette comprising a body 2, providing an inner structural element, a casing 4, providing an outer structural element and a graduation means 6, providing graphics in the form of a graduation scale.

The body 2 comprises light gauge glass covered along part of its length by the casing 4. The casing 4 comprises a plastics material. Preferably the plastics material is a chemically resistant plastic, such as FEP. Such a casing provides a chemically resistant barrier to protect the graduation means 6 from attack from the environment.

In order to prevent ingress of fluid between the body 2 and the casing 4, the casing 4 is sealed against the body 2 at each end of the casing 4.

The external surface of the body 2, is provided with a graduation means 6, in the form of a scale. The graduation means 6 comprises simple printing inks.

In an alternative embodiment, the body 2 comprises a chemically resistant plastics material, such as a fluoroplastic. In this case, a substantially unbreakable non-disposable plastic pipette may be provided.

Figure 2:
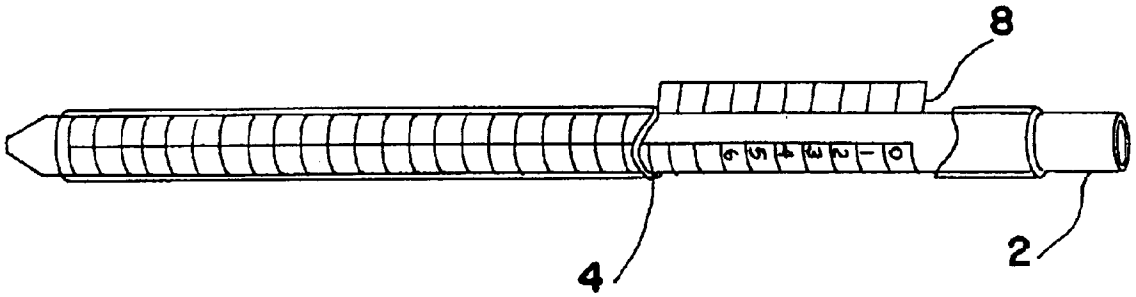
FIG. 2 shows the pipette of FIG. 1 with a cut away section.

FIG. 2 shows a pipette comprising a graduation means 6 comprising a transparent material 8 upon which the graduation scale is printed using suitable inks. The transparent film 8 is located between the body 2 and the casing 4. The transparent material 8 is applied to the body 2 by any suitable means, for example, the transparent material 8 may be self-adhesive and be applied in the form of a label.

The graphics of the graduation means 6 may comprise two-tone graphics (not shown). In this case, the graphics will be more clearly seen when pipetting fluids of any colour. For example, when pipetting dark liquids a dark scale would be almost invisible, but a lighter shaded scale would be more clearly read.

What is claimed is:

1. A pipette comprising a body, a casing and a graduation means, wherein the body comprises an elongate tubular member having a dispensing end and a reservoir portion adjacent thereto, which body is sheathed along part, at least, of the reservoir portion thereof by the casing and the graduation means is located between the body and the casing.

2. A pipette according to claim 1, wherein the pipette is a disposable pipette.

3. A pipette according to claim 1, wherein the body comprises a tubular member of substantially circular cross-sectional shape.

4. A pipette according to claim 1, wherein the body comprises glass or plastics material.

5. A pipette according to claim 1, wherein the casing extends along sufficient length of the body to cover the whole of the graduation means.

6. A pipette according to claim 1, wherein the casing has a similar conformation to the body.

7. A pipette according to claim 1, wherein the casing is sealed in such a manner as to restrict fluid entering between the body and the casing.

8. A pipette according to claim 1, wherein the casing is transparent or translucent.

9. A pipette according to claim 1, wherein the graduation means comprises graduation markings applied directly to the body or the casing.

10. A pipette according to claim 1, wherein the graduation means comprises a substrate to which graduation markings have been applied.

11. A pipette according to claim 10, wherein the substrate comprises a film.

12. A pipette according to claim 10, wherein the substrate is translucent or transparent.

13. A pipette according to claim 10, wherein the substrate is self adhesive.

14. A pipette according to claim 1, wherein the casing comprises a plastics material.

15. A pipette according to claim 1, wherein the graduation means comprises graduation markings, and the graduation markings are coloured such that they are clearly visible when the pipette contains dark coloured liquid and when the pipette contains light coloured liquid.

16. A pipette according to claim 1, wherein the graduation means comprises graduation markings applied directly to the body and the casing.

17. A pipette according to claim 1, wherein the pipette is a non-disposable pipette.

18. A method of manufacturing a pipette, comprising the steps of positioning a graduation means between a pipette body and a casing, and sheathing part, at least, of a reservoir portion of the body with the casing such that the graduation means is located between the body and the casing, and adjacent a dispensing end of the pipette.

19. A method according to claim 18, wherein the step of positioning the graduation means between the body and the casing comprises applying the graduation means to the body or the casing.

20. A method according to claim 18, further comprising the step of sealing the interface between the body and the casing.

21. A method according to claim 20, comprising positioning the substrate between the body and the casing.

22. A method according to claim 18, wherein positioning graduation means involves positioning a substrate, to which graduation markings have been applied.

* * * * *